US005882790A

United States Patent [19]

Amler et al.

[11] Patent Number: 5,882,790

[45] Date of Patent: Mar. 16, 1999

[54] SEWING THREAD ESPECIALLY BULK THREAD

[76] Inventors: Werner Amler, RingStrasse 25; Thomas Seitz, Simonshofer Strasse 1, both of D-91207, Lauf, Germany

[21] Appl. No.: 849,533

[22] PCT Filed: Dec. 15, 1995

[86] PCT No.: PCT/DE95/01838

§ 371 Date: Jun. 20, 1997

§ 102(e) Date: Jun. 20, 1997

[87] PCT Pub. No.: WO96/19603

PCT Pub. Date: Jun. 27, 1996

[30] Foreign Application Priority Data

Dec. 21, 1994 [DE] Germany ..... 44 47 359.1

[51] Int. Cl.[6] ..... D02C 3/00

[52] U.S. Cl. ..... 428/364; 428/375

[58] Field of Search ..... 428/364, 375; 8/137

[56] References Cited

U.S. PATENT DOCUMENTS 4,584,214 4/1986 Eiermann ..... 428/289
5,542,951 8/1996 Antwerpen et al. ..... 8/137

*Primary Examiner*—Newton Edwards
*Attorney, Agent, or Firm*—Eric P. Schellin

[57] ABSTRACT

The invention concerns a sewing thread at least the surface of which comprises a product which imparts stability to the thread and renders thread extension more difficult when the thread is sewn in. The thread is nevertheless still so elastic that it lends itself well to stitching and returns to its original state after washing.

3 Claims, No Drawings

SEWING THREAD ESPECIALLY BULK THREAD

The invention relates to a sewing thread.

BACKGROUND OF THE INVENTION

DE-A-1,265,109 teaches a sewing thread of twisted, endless, synthetic threads onto which a dried dispersion is applied in an expensive work process. However, the purpose of the preparation thereby is not the concentration of the thread circumference but that a sufficient thread-on-thread adhesion should be achieved in order to prevent a shifting of the thread and an undesired falling off of the outer thread layers on the sewing-yarn or thread body.

The dispersion mentioned in DE-A-1,265,106 can not be washed out in the actual sense but rather must be dissolved with organic solvents. However, the use of such organic solvents contravenes the legal regulations for the treatment of textiles for human use. The organic solvents cited in this prior publication can therefore not be used for articles of clothing.

Many requirements are placed on a sewing yarn or thread, especially, it should be able to be processed on machines, even on automatic sewing machines, and meet special conditions regarding quality and softness of a seam sewn therewith.

Traditional sewing yarns have the problem that they require a construction, on account of the demands placed on them, which has a certain hardness after the sewing and in the seam.

A quite essential quality feature of a seam is that the two areal structures to be connected are joined via the seam in such a manner that the desired softness is achieved and a gapping of the seam as well as fraying are avoided. Only in this manner can the functional and esthetic requirements of a seam be met.

The cause for the seam wrinkling is to be found in the fact that the sewing thread is too strongly elongated or stretched when passing through the guides and the thread levers of the sewing machine. After the sewing process the sewing thread shortens back into its initial length (memory effect). As a result thereof, the undesired seam wrinkling occurs in the seam since the thread can only go back by the contraction of the flexible areal structures in the seam. The back formation takes place successively as a function of the stability of the flexible areal structure, that is, of the materials to be sewn. The back formation of the thread can take place, depending on structure and composition, wherein one hour but possibly also not until after a few days. In certain instances the back formation takes place only after one or several washing processes or cleaning processes. This depends in the particular individual instance on within which times and by means of which processes the stabilizing agents contained in the fabric can be dissolved or converted by the washing or the cleaning.

It can basically be stated that the seam wrinkling always occurs if the back formation force of the sewing thread is greater than the stability of the material connected by the sewing thread via the seam.

The invention has the problem of creating a sewing thread which is designed so that the desired seam strength is achieved by the elongation during sewing but the restoration forces (memory effect) which otherwise take effect within a time period can not occur.

A further essential quality feature of a seam is that it does not affect the wearing properties and is not perceived as being very troubling. The fact is disadvantageous in particular in the case of bathing garments, underwear, bodices and the like that the softness of these garments worn directly on the body is lost when traditional sewing yarns are used.

The invention has the problem of preparing a bulk yarn or thread which ordinarily can not be sewn as a needle thread or can not be economically sewn and to process it in such a manner that it can be sewn on modern sewing machines and automatic machines and that the seam strength given by the raw material and the construction of the sewing yarn achieves the original softness again even after the sewing and after a subsequent washing.

The problem of the invention is solved by the features of claim 1.

Advantageous further developments result from the subclaims.

SUMMARY OF THE INVENTION

The special measures of the invention bring it about that practically any commercial sewing thread can be prepared in such a manner that the undesirable properties in and/or after a machine sewing are negated and avoided.

To this end the yarn, preferably of synthetic material, in a soft structure but also with slight ply twist and bulky, voluminous structure, is conducted through a dispersion in such a manner that it is coated with the dispersion in a preparative manner. This sewing thread is also optionally impregnated in such a manner with the dispersion, as a function of the structure of said thread, that any fine pores and any interstices are filled up therewith and in the case of multifilament yarns the individual threads are mutually joined to each other. The dispersion applied onto or introduced into the sewing thread is subsequently dried, which gives the sewing thread its stability.

As a result of this treatment an undesirable opening of the sewing thread during the sewing is avoided. This assures that bulk yarn can be universally used as needle thread and as looper thread.

If applicable, a twisting open of the individual threads of a cotton sewing yarn is prevented by the stabilizing action when sewing on automatic machines. A more favorable seam structure and a greater seam strength results. In addition, an uninterrupted sewing is assured in that the sewing yarn is not subject to any delay in the longitudinal axis ("twist accumulation") in front of the tensioning units.

A dispersion power emulsifiable in water and based on a terpolymer of ethylene, vinyl laurate and vinyl chloride has proven to be especially favorable for the dispersion through which the thread is conducted during its course of treatment.

This improves the adhesive strength, flexural tensile strength, deformability, wear resistance and the processability of the sewing threads treated therewith.

A dispersion powder of a vinyl acetate ethylene copolymer with good saponification resistance and emulsifiable in water can also be used. By virtue of a relatively high ethylene content this resin is softer, more elastic and slightly more tacky. This dispersion powder is particularly well suited. Deformability and wear resistance are improved.

Moreover, both dispersion powders have a color-stabilizing property.

These dispersions can also be mixed with one another.

If necessary, an antiblocking agent can be added to these mixtures, e.g., a copolymer dispersion of acrylic acid ester with a minimum film-forming temperature of above 100° C. and precipitated silicic acid or pyrogenic silicic acid.

The particular mixtures can be adapted to the physical qualities of the sewing yarn by an appropriate selection.

A particular advantage of the above-mentioned dispersion powders is the fact that they can be washed out again at low wash temperatures already so that after the sewing process the bulky sewing thread is again present in its initial state.

EXAMPLE

The process of preparing a bulky sewing thread is described by way of example in the following:

A synthetic, bulky sewing yarn is drawn over a special roller which dips into a pan with an aqueous dispersion described above. The sewing yarn is subsequently dried in a continuous process in a heating stretch and wound up. A sewing yarn treated in this manner can be readily drawn off from the lap or roll, sewn and subsequently returned to its original (bulky) state by means of a customary washing process.

A sewing thread treated in the manner described above also exhibits in addition to the structural stabilization a water-repellant property and a color stabilization. Nonwash-proof colors are stabilized in such a manner by the above-described treatment that they can practically not be washed out.

It is recommended for all plastic threads with high elongation that a plastic dispersion be selected which has a high elongation at tear after drying e.g. all lattices, and which can be washed out during the washing procedure.

We claim:

1. A sewing thread having on at least the surface thereof a coating of a dried dispersion which imparts stability to the thread and impedes stretching thereof during sewing, but allows the thread to retain flexibility for sewing, and which can be washed out after the thread has been sewn in place comprising an emulsifiable plastic and an additive of a polysaccharide.

2. The sewing thread of claim 1 wherein the emulsifiable plastic is a terpolymer of ethylene, vinyl laurate and vinyl chloride.

3. The sewing thread of claim 2 wherein the emulsifiable plastic is vinyl acetate-ethylene copolymer.

* * * * *